United States Patent [19]

Carlson

[11] Patent Number: 4,771,974

[45] Date of Patent: Sep. 20, 1988

[54] CLIP FOR HANGING OBJECTS FROM BRICK WALLS

[76] Inventor: Eddie R. Carlson, 3422 Colwell, Troy, Mich. 48084

[21] Appl. No.: 263,527

[22] Filed: May 14, 1981

[51] Int. Cl.[4] ..... E04G 3/00

[52] U.S. Cl. ..... 248/231.8

[58] Field of Search ..... 248/231.8, 231.7, 316.9, 248/316.1

[56] References Cited

U.S. PATENT DOCUMENTS 2,665,869 1/1954 Samuels ..... 248/226.5
2,977,807 4/1961 Conover ..... 248/226.5
4,112,550 9/1978 DeWitt et al. ..... 248/226.5
4,337,915 7/1982 Cali ..... 248/226.5

*Primary Examiner*—Ramon O. Ramirez
*Attorney, Agent, or Firm*—Krass & Young

[57] ABSTRACT

A spring steel clip having inwardly angled resilient legs, extending from one side and being adapted to engage opposite surfaces of a brick. A prong extends from the opposite side of the clip in an upward direction and is disposed for hanging objects therefrom. By separating the legs, the clip can be attached to a brick and is retained on the brick by the spring tension exerted by the legs. The clip is heat treated to provide strength and resiliency.

6 Claims, 1 Drawing Sheet

Fig-1
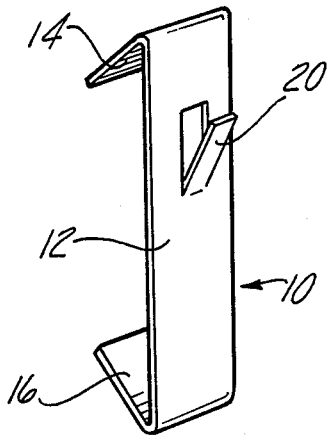
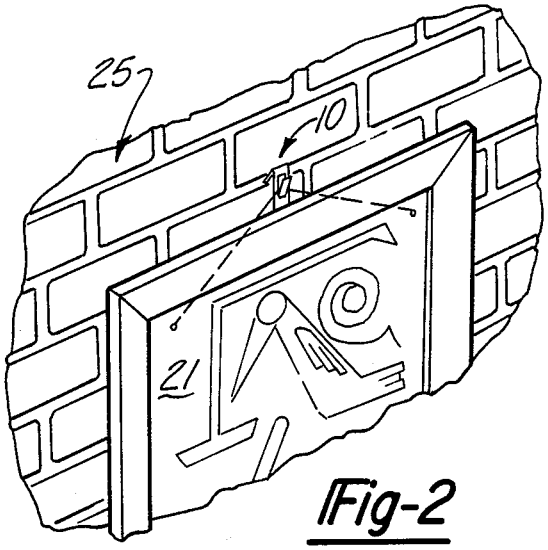
Fig-2
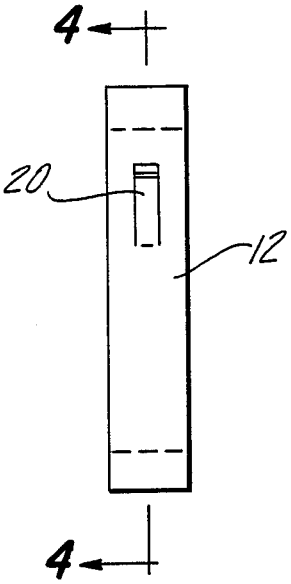
Fig-3
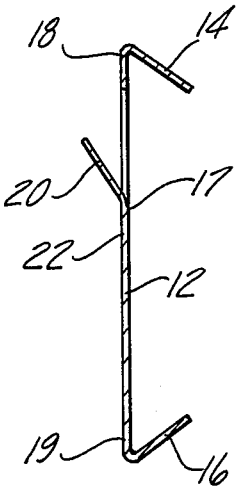
Fig-4
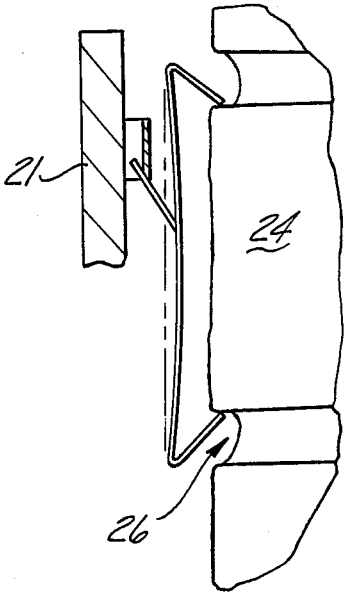
Fig-5

CLIP FOR HANGING OBJECTS FROM BRICK WALLS

DESCRIPTION

TECHINCAL FIELD

This invention relates generally to brackets, clips, and the like for supporting objects on a wall. In particular, there is provided a spring steel clip especially adapted for spanning a single brick and engaging the upper and lower surfaces of the brick to provide a means for hanging an object.

BACKGROUND ART

Brackets, nails, bolts and similar fastening devices are known to be used for supporting objects from brick and mortar walls. Such fastening devices typically encounter numerous problems in installation, use and removal. Inserting a masonry nail or a screw type device in a masonry wall is likely to cause damage to the brick or mortar. Either type of fastener may cause the mortar or brick to crack and become loosened, especially when a heavy object is attached to the fastener. If the mortar is cracked or a hole is made, water may enter the crack or hole and accentuate the damage. Removal of a traditional fastener is difficult and may result in further injury to the brick and mortar.

Special fasteners such as expansion screws and lag bolts are often used to provide a secure anchor on the masonry wall. Special purpose fasteners are difficult to install and usually require pre-drilling holes in the wall prior to installation of the device. Water can enter such a hole and through expansion and contraction cause significant damage to the mortar or brick. Special purpose fasteners are usually permanently secured to the wall and are not removable without causing considerable damage to the wall.

Special clips are known for securing lightweight objects to brick walls. One example of such a device, as disclosed in U.S. Pat. No. 4,201,013 to Robbins, is a wire clip having a pair of bent end portions and an intermediate outwardly projecting portion formed as a loop for retaining a plant vine. The device may be simply installed on a brick wall without damaging the wall, but is limited in the amount of weight it can support. If an object such as a picture were suspended from the loop the downward pressure exerted on the loop would pull the end portions away from the brick.

Another clip for holding objects on a brick wall is disclosed in U.S. Pat. No. 4,145,840 to Davidson. Davidson discloses a U-shaped clip of spring steel having two legs for engaging opposite surfaces of adjacent bricks across a mortar joint. The clip is intended only for non-load bearing applications such as fastening plant vines to a wall. If an object of substantial weight is placed on the clip the downward force would cause the upper leg to be pulled forward and become disengaged from the mortar joint.

It is an object of the present invention to provide a clip for hanging pictures and like objects from a masonry wall. The clip is adapted to span a brick, engaging the top and bottom surfaces of the brick between opposed resilient members. The grip depth of the device is relatively short, yet the grip of the device according to the present invention is strong enough to permit heavy objects to be suspended from the clip. The construction of the clip makes it resistant to being pulled away from the brick face by heavy objects.

The clip may be secured to a masonry wall without drilling holes or otherwise penetrating the wall which could cause damage to the mortar or brick. The body of the clip is designed to be installed nearly flush to the wall and does not detract from the appearance of the wall.

The clip is simply formed from spring steel formed by normal sheet metal forming operations and is specially heat treated to provide excellent gripping strength.

SUMMARY OF THE INVENTION

The present invention is a fastening device for hanging relatively heavy objects, such as pictures, sculptures or other objects from upstanding masonry walls. The inventive fastening device comprises a unitary resilient member having first and second legs extending inwardly from opposite ends of the clip on one side of the clip. Each leg is elastically deformable away from the other leg. The clip is secured to a brick by the legs exerting pressure upon opposite sides of the brick. A prong projects upwardly from the opposite side of the clip to provide a means for hanging a picture or other objects from the clip.

The clip is simply formed by sheet metal forming techniques and is heat treated to provide strength and resiliency necessary to grip the masonry wall.

The device of the present invention is easily secured to a wall by slipping the opposite legs of the clip over a single brick and allowing the legs to bear upon opposite surfaces of the brick. The opposed resilient leg members are capable of exerting considerable gripping pressure on a brick while only requiring a shallow mortar crevice for gripping the brick.

The superior gripping ability of the device permits heavy objects to be attached to a wall without installing permanent fasteners in the wall such as expansion screws or lag bolts which are difficult to remove and cause considerable damage to the wall.

These and other objects and advantages of the invention will appear from the following description and accompanying drawings.

BRIEF DESCRIPTION OF THE DRAWINGS

FIG. 1 is a perspective view of the clip.

FIG. 2 is a perspective view of the clip supporting a picture on a wall.

FIG. 3 is a front view of the clip.

FIG. 4 is a sectional view of the clip taken along line 4—4 FIG. 3.

FIG. 5 is a side view of the clip in engagement with a brick.

BEST MODE FOR CARRYING OUT THE INVENTION

Referring to the drawing, a clip for hanging objects from a brick wall is illustrated in FIGS. 1 through 5 and is designated generally by reference numeral 10.

The clip 10 is a unitary structure having a body 12 and first and second legs 14 and 16 extending on one side 17 from first and second opposite ends 18 and 19 of the body 12 and are elastically deformable away from each other such as to cause the body 12 to flexurally bow inwardly when said clip is engaged with a brick edge 24 and subsequent force is applied by the attachement of an object. The legs 14 and 16 are disposed at an acute angle relative to the body 12. A prong 20 for attaching objects 21 to the clip 10 extends upwardly from a point intermediate the other side 22 of the body 12.

The body 12 is rectangular in shape and made of cold rolled spring steel. In a preferred embodiment, the clip 10 is formed from AISI 1095 steel. The length of the body 12 exceeds the measure of the brick 24 that it is designed to engage. The clip 10 may be made in various sizes to fit differently sized bricks, however due to the resiliency of the device, it is not limited to a precise brick size.

First and second legs 14 and 16 are rectangular in shape and extend from the ends 18 and 19 toward each other. Each leg 14 and 16 is disposed at an angle of about 55° with the body 12. The acuteness of the angle allows the device to be installed on brick walls 25 having only a shallow crevice 26 between each brick 24. The angle at which the legs are disposed is important for developing the grip strength of the clip 10. The legs 14 and 16 are formed from the same piece of steel as the body 12.

The prong 20 is stuck out from the other side 22 of the body 12 to extend at an angle of approximately 30° from the body 12. The prong 20 is thus adapted to receive an object 21, or hanging means such as a picture wire. It is to be understood that other types of projections could be attached to the body 12, instead of striking the prong 20 from the body 12, without departing from the spirit of the invention.

The clip 10 is formed by cutting a blank having a length equal to the length of the body 12 plus the length of both legs 14 and 16. The legs are then bent to the position as shown in FIG. 4, and the prong 20 is formed by cutting one end of the prong 20 from the body 12 and bending the prong 20 outwardly as shown in FIG. 4.

After forming clip 10, it is then heat treated to assure resiliency and to relieve cold working stresses. Heat treatment according to the preferred method is accomplished by heating. The clip 10 is heated between 1400° F. and 1450° F. and then water quenching the clip 10 to approximately 1000° F. The clip is then tempered at 1000° F. to relieve any stresses caused by quenching and to provide toughness.

The clip 10 may be painted, dipped or otherwise coated with a corrosion resistant material to prevent deterioration of the clip 10.

The clip 10 is attached to a brick 24 by separating the legs 14 and 16 and sliding them over the brick 24. The legs 14 and 16 may be separated by flexing the ends 18 and 19 of the body 12 away from the brick 24, or by prying the legs 14 and 16 apart. Once the legs 14 and 16 are spread sufficiently the clip is placed on the brick 24 so that the body 12 is as close as possible to the face 26 of the brick 24. In this position the prong 20 extends away from the brick to allow objects to be suspended from the prong 20. By locating the prong 20 close to the face of the brick 24, the forces exerted on the prong 20 are primarily directed parallel to the wall 25 thereby minimizing any tendency of the object to pull the clip 10 away from the wall 25.

It should be apparent from the above description that installation of the clip 10 requires no material removal and does not require penetration of the wall 25. The clip 10 may be installed easily by hand or by the use of simple tools. The clip 10 causes no damage to either the brick or mortar of the wall 25, and yet is a secure anchor capable of supporting heavy objects.

It is to be understood that the invention has been described with reference to a specific illustrative embodiment, that various modifications are possible, and that the description is not to be construed in a limiting sense.

The embodiments of the invention in which an exclusive property or privilege is claimed are defined as follows.

1. A clip device for attachment to recessed mortar masonary walls and the like and for hanging objects therefrom, comprising a unitary elongate member of flat, resilient strip material of substantially uniform width and having a resilient central portion, a first leg extending inwardly from one end of said central portion on one side, a second leg extending inwardly from the other end on the same side of said central portion, said first and second legs being disposed to extend toward each other at an angle relative to said central portion and being elastically deformable away from each other to grip a brick edge, said edge arbitrarily chosen to be of width X, the inner span of the clip having a length less than X and the outer span of the clip having a length greater than X such that when the clip device is engaged with a brick edge said central portion will be flexurally bowed inwardly causing the inner span of the clip to increase in length and the outer span of the clip to decrease in length, and a prong projecting intermediately from said central portion and extending from a second side of said central portion.

2. In the clip device of claim 1 wherein said device is coated with a corrosion resistant material.

3. In the clip device of claim 1 wherein the first and second legs are disposed at an angle approximately 55° from said elongate member.

4. In the clip device of claim 1 wherein said device is fabricated from cold rolled spring steel.

5. In the clip device of claim 1 wherein first and second legs terminate in a non-pointed end.

6. In the clip device of claim 5 wherein said device is fabricated from AISI 1095 cold rolled spring steel.

* * * * *